US005746671A

United States Patent [19]

Ritchie

[11] Patent Number: 5,746,671

[45] Date of Patent: May 5, 1998

[54] PITCHER'S TRAINING DEVICE AND METHOD OF TRAINING

[76] Inventor: Gregory Ritchie, Rte. 1, Box 933, Mineral, Va. 23117

[21] Appl. No.: 581,160

[22] Filed: Dec. 29, 1995

[51] Int. Cl.[6] ..... A63B 69/00

[52] U.S. Cl. ..... 473/454; 473/456

[58] Field of Search ..... 273/26 A, 26 D; 473/197, 451–456, 462, 102–104

[56] References Cited

U.S. PATENT DOCUMENTS

| | | | |
|---|---|---|---|
| 1,170,715 | 2/1916 | Westgate | 273/26 A |
| 1,879,316 | 9/1932 | Kleb | 273/26 A |
| 2,657,058 | 10/1953 | Mulcahy | 273/26 A |
| 2,915,314 | 12/1959 | Phillips | 273/26 A |
| 3,011,784 | 12/1961 | Segretto | 273/26 A |
| 5,046,729 | 9/1991 | Yancey | 273/26 A |
| 5,333,856 | 8/1994 | Gery | 273/26 A |
| 5,439,211 | 8/1995 | Drabowski | 273/26 A |
| 5,484,145 | 1/1996 | Shriver | 273/26 A |

FOREIGN PATENT DOCUMENTS

| | | | |
|---|---|---|---|
| 397260 | 8/1933 | United Kingdom | 473/104 |

OTHER PUBLICATIONS

"The Pitcher's Helper", Dick Bixler Sports Inc. brochure, Alva, Oklahoma.

"The StrikePro™", Baseball Parent, vol. 1, No. 3, p. 3, Aug.–Oct. 1995, Knoxville, Tennesse.

"Jugs Backdrop", and Protective Screens, 1995 Baseball Equipment Handbook, pp. 77 and 79.

"Canvas Catcher and Frame", Practice Partner, and 3–Way Fielder's Choice, Markwort Baseball/Softball Catalog, p. 47, Markwort Sporting Goods Company, 1995, St. Louis, Missouri.

"The Seven Footer Square Screen With Sock Net", p. 11, and Backdrop and Pitcher's Trainer, p. 23, Jugs Accessories, Jugs Baseball Only Catalog, The Jugs Company, Tualatin, Oregon.

*Primary Examiner*—Mark S. Graham

*Attorney, Agent, or Firm*—Fish & Richardson P.C.

[57] ABSTRACT

The invention relates to the field of sports training equipment, particularly to a device and methods for training baseball players. A pitcher's training device in accord with the present invention provides a tarpaulin mounted to a frame. Various targets are positioned on the tarpaulin. Lead lines, which are attached to the frame beneath the targets, are extended out toward the pitcher. The pitcher then throws the baseball towards the target, using the lead lines as a guide to the throw.

In accord with another aspect of the invention, a method of training a baseball pitcher is also provided. The frame is positioned around home plate. A lead line is attached to the tarpaulin directly below at least a first target and extended toward the pitcher. A triangle is defined by three targets. A baseball is thrown at the triangle by a pitcher. The lead lines define an alley for the pitcher to throw the ball.

62 Claims, 6 Drawing Sheets

PITCHER'S TRAINING DEVICE AND METHOD OF TRAINING

BACKGROUND OF THE INVENTION

The instant invention is the subject of Disclosure Document No. 352,234 filed in the U.S. Patent & Trademark Office on Apr. 18, 1994. It is respectfully requested that the disclosure document be retained beyond the two-year period so that it may be relied upon as evidence of conception of the invention during the prosecution of the application, should the need arise.

The present invention relates generally to the field of sports training equipment and, more particularly, to a baseball player training device and methods of training players.

Baseball players, in particular pitchers, must be able to accurately throw a baseball. Various devices have been developed that position targets on a tarpaulin. The pitcher trains by throwing baseballs at the target and adjusting as necessary to hit the target with the ball. These prior art devices do not establish targets that correspond closely to the requirements of an actual game situation. Further, other than providing the target, these devices do not otherwise direct the baseball thrower to become more accurate.

Baseball hitters must be able to swing a bat with great control so naturally that they need not concentrate on the mechanics of the swing. However, it is difficult for a hitter to judge whether the mechanics of his own swing are proper. Various devices have been developed that give the hitter feedback or otherwise help to improve the hitter's control. However, no single device is known that can help train both hitting and throwing.

SUMMARY OF THE INVENTION

A pitcher training device in accord with the present invention provides a tarpaulin mounted to a frame. Various targets are positioned on the tarpaulin. Lead lines, which are attached to the frame beneath the targets, are extended out toward the pitcher. The pitcher then throws the baseball towards the target, using the lead lines as a guide to the throw. The pitcher can adjust the mechanics of his delivery as required to better hit the target.

In accord with another aspect of the invention, a method of training a baseball pitcher is also provided. The frame is positioned around home plate. A lead line is attached to the tarpaulin directly below at least a first target and extended toward the pitcher. A triangle is defined by three targets. A baseball is thrown at the triangle by a pitcher. The lead lines define an alley for the pitcher to throw the ball. The pitcher can adjust the mechanics of his delivery as required to hit the target.

In accord with another aspect of the invention, a method of training a player to hit a baseball with a bat is provided. A sports training device having a frame, a tarpaulin mounted to the frame, and targets disposed on the tarpaulin, is positioned either in front of or behind the hitter. The hitter then swings the bat, either at a baseball or not. The tarpaulin provides feedback to the hitter concerning his swing.

Other features and advantages of the present invention will become readily apparent to those of ordinary skill in the art by reference to the following Detailed Description and accompanying drawings.

BRIEF DESCRIPTION OF THE DRAWINGS

A better understanding of the invention may be had from a consideration of the following Detailed Description, taken in conjunction with the accompanying drawings in which.

DETAILED DESCRIPTION

Figure 1:
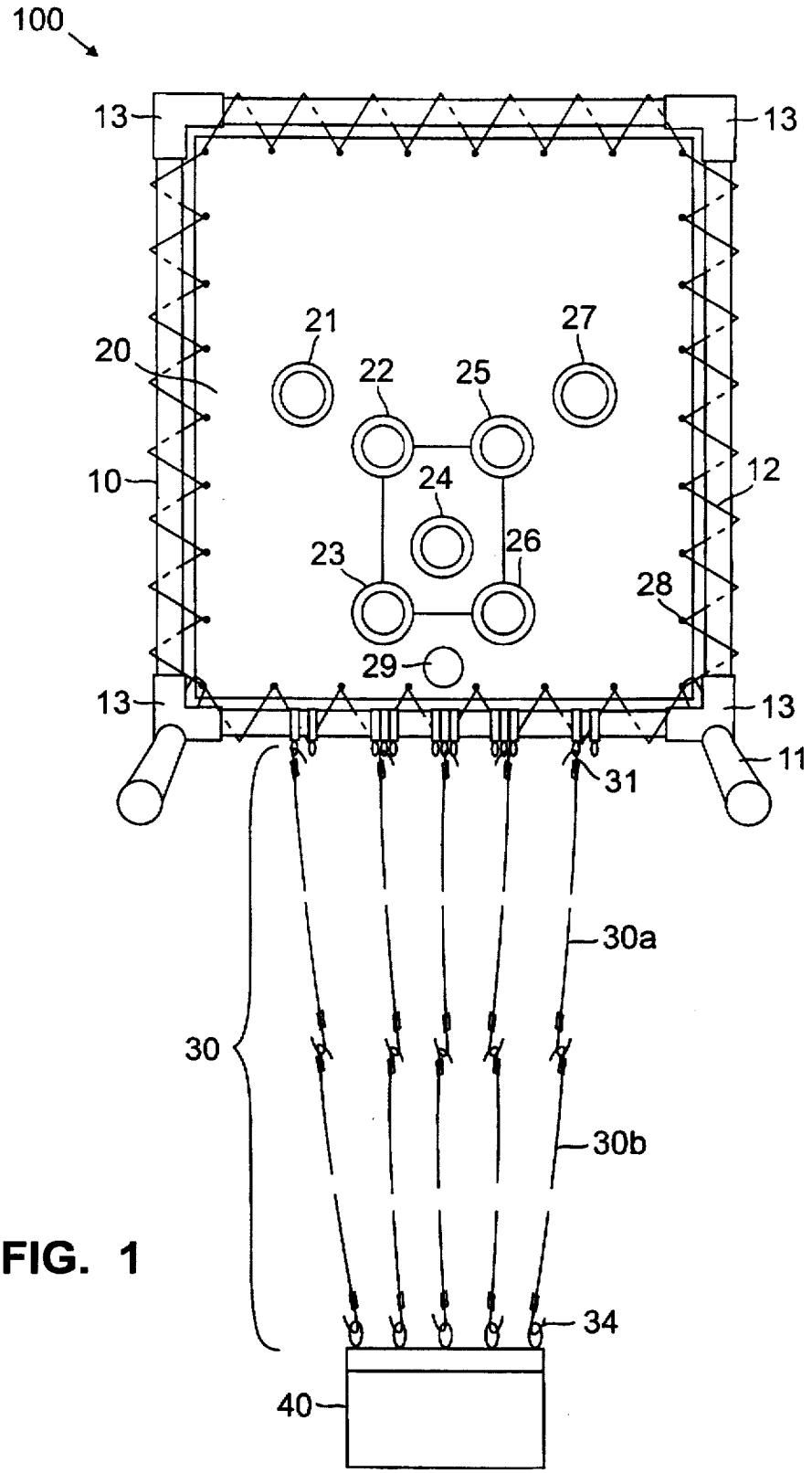
FIG. 1 is a front view of a baseball training device.

FIG. 1 is a front view of an embodiment of the baseball training device 100 of the present invention. A frame 10 is formed, preferably about 8 feet square and made of steel tubing having a two inch diameter. Corner pieces 13 may be employed to connect the tubes of the frame. Footings 11, which also are made of steel tubing having a two inch diameter, are mounted to the bottom of the frame, extending forward and rearward perpendicular to the frame, thus operating as a vertical support for the frame. Consequently, the frame is maintained in a vertical position, perpendicular to the ground. A truss 14 may be attached to a footing and the frame for additional support (see FIG. 2). Of course, other means of supporting the frame could also be employed and still practice the invention. In particular, footings could extend straight down from the frame and be buried in the ground.

Figure 1A:
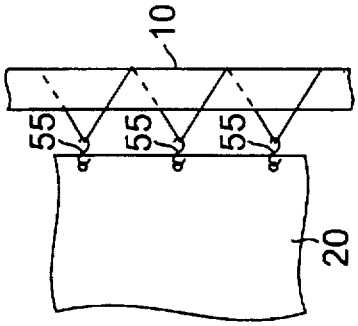
FIG. 1A is an isolation view of the frame and tarpaulin of the baseball training device of FIG. 1.

A tarpaulin 20 is disposed within the frame 10. As discussed more fully below, targets 21–27 are positioned on the tarpaulin. A cord 12 is threaded about the frame 10 and through apertures 28 located at the periphery of the tarpaulin. Preferably, the cord is a flexible cable, such as a bungee cord, thereby reducing stress on the tarpaulin and the cord during use. Other methods of attaching the tarpaulin to the frame would also be acceptable and still practice the invention. For example, as shown in FIG. 1A, an isolation view of the tarpaulin and the frame, S-hooks 55 may be used to connect the apertures of the tarpaulin to the cord.

Figure 2:
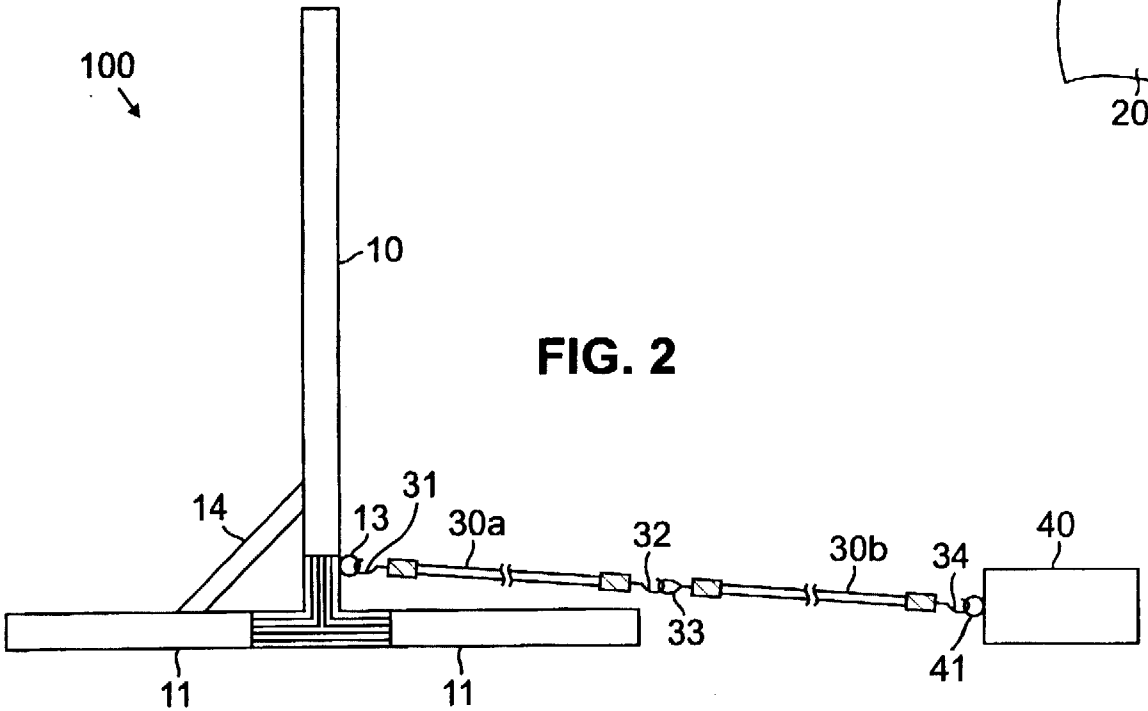
FIG. 2 is a side view of the baseball training device of FIG. 1.

Lead lines 30 are attached to the bottom of the frame 10 (or, as discussed below, to the tarpaulin) and extend to an anchor plate 40. Each lead line is substantially located directly below at least one target and may include at least two sections, **30*a* and 30*b*, of line. As seen in FIG. 2, a side view of the baseball training device shown in FIG. 1, a hook 31 is attached at a first end of the section 30*a* and engaged to an eye 13 or other fastener mounted to the frame or to the tarpaulin 20. Another hook 32 is attached to the second end of the second 30*a* and is engaged to an eye 33 attached to the first end of the section 30*b*. A hook 34 attached to the second end of section 30*b* is attached to the anchor plate 40 at an attachment point 41**. Preferably, the anchor plate and the lead lines are sized so that the lead lines extend radially from the thrower (for example, from the pitcher's mound) to the targets. Ideally, the lead lines extend to the center of the targets.

The length of the lead line 30 may be adjusted by removing the second section **30*b* and allowing section 30*a* to simply lie on the ground. Other types of lines may be employed as the lead line and still practice the invention. For example, a self-coiling belt with a spring lock can be mounted to the frame 10** or to the tarpaulin such that a desired length of belt can be pulled out for each use. Alternatively, various lengths of line can be supplied with the pitcher training device and selected for each use. However, the length of the lead line should be selected so that the player has sufficient space to land after throwing without tripping on the lead line.

Figure 3:
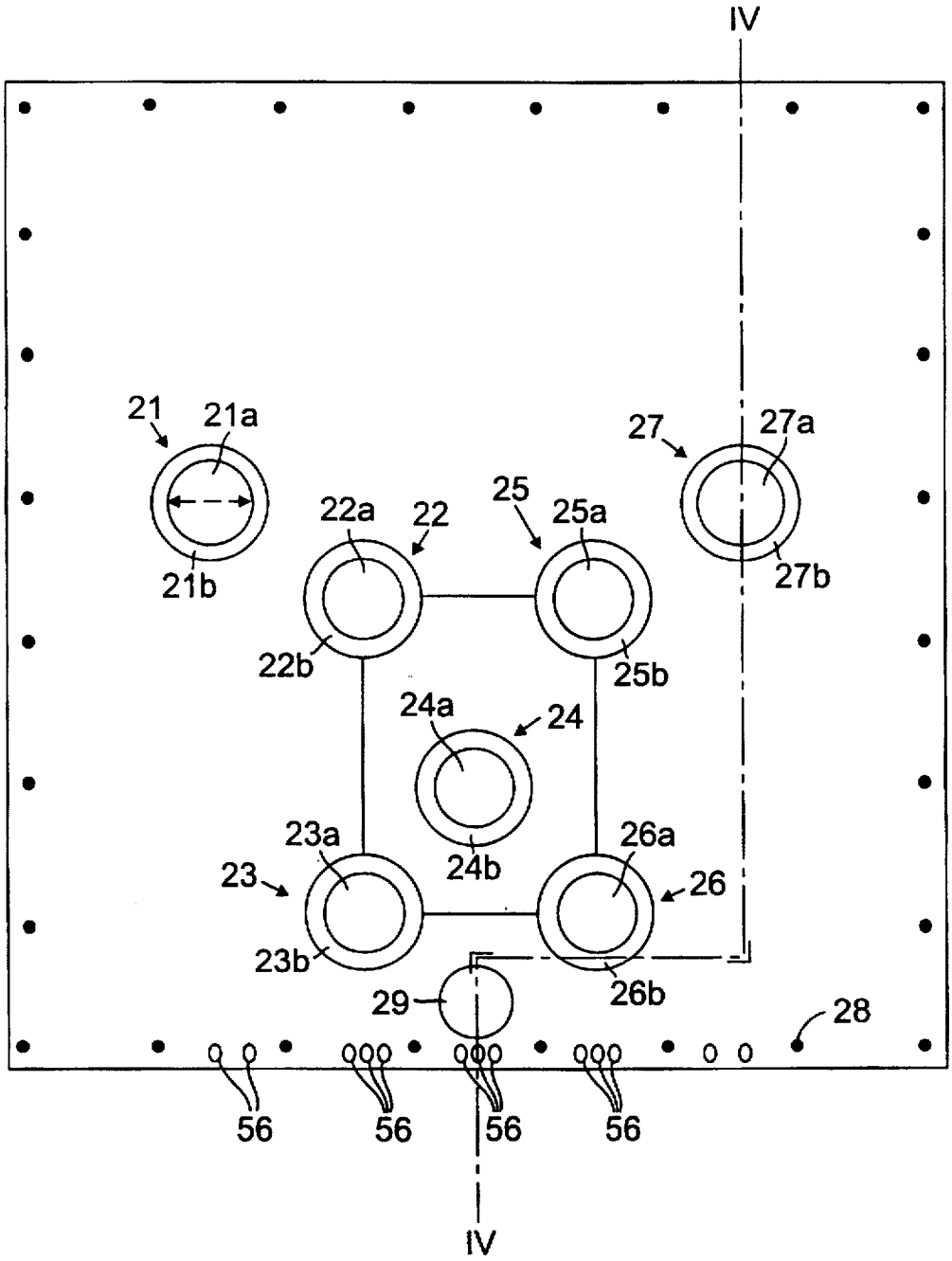
FIG. 3 if a front view of a tarpaulin for use with the baseball training device of FIG. 1.

FIG. 3 is a front view of the tarpaulin 20 shown in isolation. Preferably, the tarpaulin is about 86 inches wide and 73 inches high. The apertures are disposed about 1 inch in from the edge of the tarpaulin and spaced about 9 inches apart. Due to the close positioning of the apertures, a baseball cannot pass between the cord 12 and the tarpaulin at a high velocity. Fasteners, such as holes or loops 56 attached to the tarpaulin by nylon belts, can be positioned below each target for attachment to the lead lines. Consequently, the lead lines may be attached directly to the tarpaulin, rather than to the eye 13 on frame 10.

Seven targets 21–27 are located on the tarpaulin 20. Each target includes a round opening **21*a*–27*a* having an inner diameter of about 6 inches and a colored ring 21*b*–27*b* having a width of 1.25 inches surrounding each opening. A reinforcement band may be attached about the openings. The lead line 30 disposed below each target may be of color matching the ring directly above it. Targets 22, 23, 25, 26 form a rectangle, about 24.5 inches high and 19 inches wide, corresponding to a strike zone of a major league hitter. Target 24 is located slightly below the center of the rectangle. Targets 21 and 27 are located outside and above the rectangle corresponding to the locations of a "brushback" pitch or a pitch out. Of course, other arrangements of the targets could be employed and still practice the invention. For example, targets 71 and 77** (see FIG. 7) can be provided directly below the brushback and pitch out targets.

Figure 4:
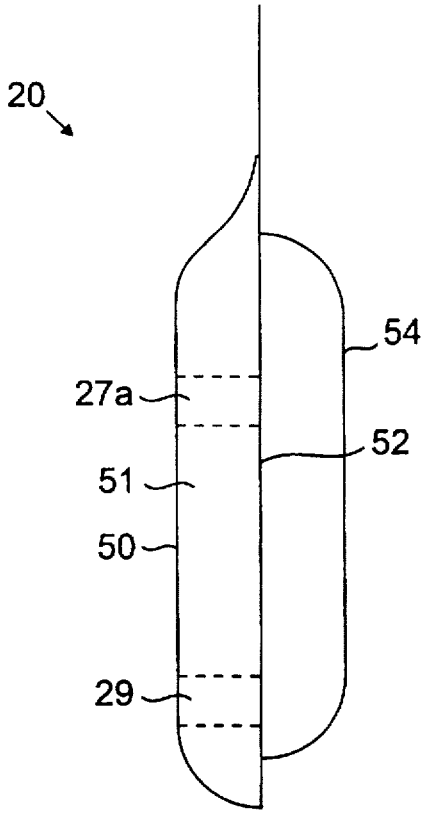
FIG. 4 if a cut-away side view of the tarpaulin of FIG. 3.

FIG. 4 is a cut-away side view of the tarpaulin 20 of the baseball training device shown in FIG. 1. A sheet of sponge foam 51, preferably composed of polypropylene approximately ¼" to ⅜" thick, is disposed between a front sheet 50 of polyvinyl material and a rear sheet 52 of polyvinyl material. Preferably, the front sheet and the sponge foam extend from the bottom of the rear sheet to about one foot above the highest target. The sheets of polyvinyl material are preferably 18 ounce grade. The edges of the rear sheet are folded over the edges of the front sheet and sewn together, through the sponge foam. Preferably, the polyvinyl sheets are quilted together by 16 inch square seams. Smaller seams may also be employed.

Figure 5:
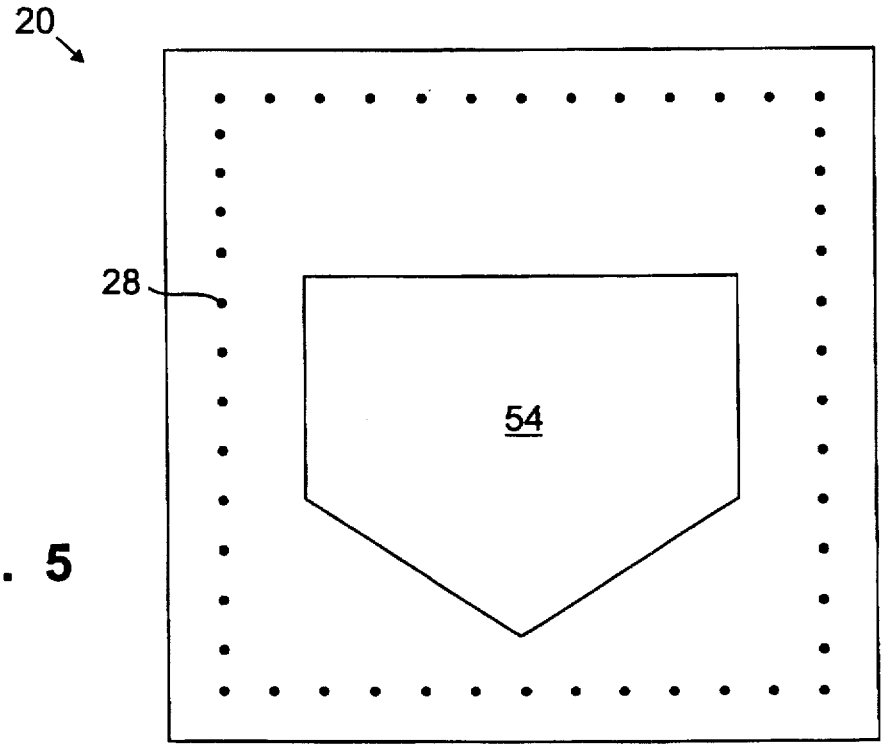
FIG. 5 is a rear view of the tarpaulin of FIG. 3.

Openings **21*a*–27*a* for the targets 21–27 are punched through the polyvinyl sheets and the sponge foam. A catch bag 54 is sewn on to the rear polyvinyl sheet by a seam that surrounds the openings of the target and the exit hole. When balls pass through the openings, they hit the catch bag. Falling between the catch bag and the rear polyvinyl sheet, the balls roll out through exit hole 29 which also may be used as a target. Preferably, the exit hole is aligned vertically with the center target 24**. As seen in FIG. 5, a rear view of the tarpaulin, the catch bag is shaped to direct the balls to the exit hole.

Figure 6:
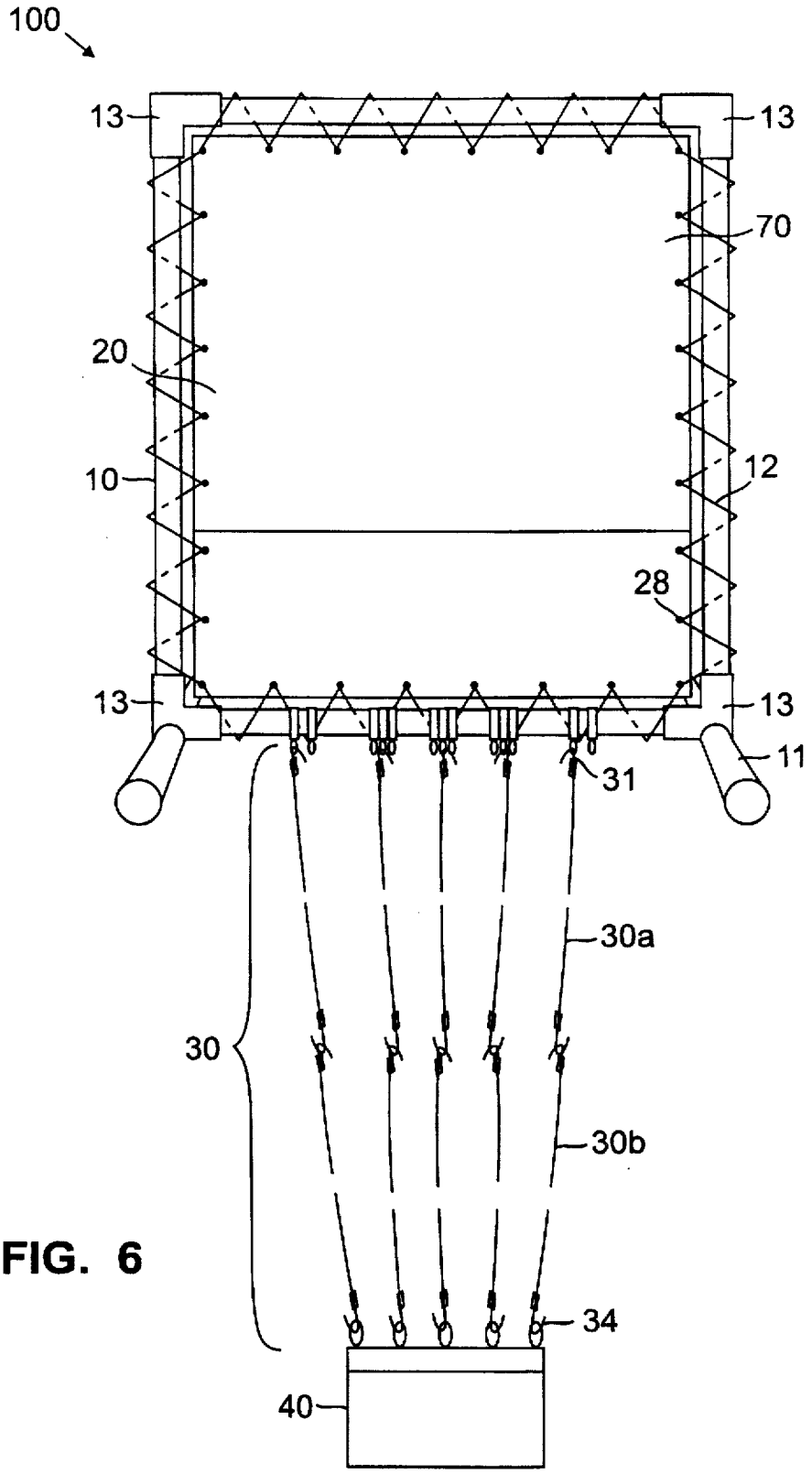
FIG. 6 is a front view of the baseball training device of FIG. 1 for training other players.

FIG. 6 is a front view of the baseball training device of FIG. 1 for training other players. A matting 70 is threaded onto the cord 12, hooked onto the cord 12 by S-hooks, or attached to the frame 10 by any other manner known in the art. Any arrangement of targets may be employed on the matting. As shown in FIG. 6, a horizontal line is disposed on the matting at about knee or waist height. The player throws at the matting, trying to throw either above or below the line, as directed by a coach.

To operate the device 100 of the present invention for training pitchers, the top of the tarpaulin is aligned with the top of the frame and then hooked to the frame 10. If the device is to be used for children, such as at the Little League level, the tarpaulin is lowered a distance selected by the coach (for example, about 5 inches) below the top of the frame and then hooked into place. Any excess length of tarpaulin at the bottom is folded back behind the frame.

The frame 10 is located on the field at a position to which the player should throw. Typically, the frame is positioned over home plate on a baseball field for pitching practice. As discussed below, the frame could be located at other positions on the field to train fielders throwing to other bases. A lead line 30 is attached to the loop 56 on the tarpaulin 20 below the target which the player will attempt to hit. The first section **30*a*, typically 38 feet long, is attached to the tarpaulin. The second section 30*b*, typically 17 feet long, is attached to the first section. The second lead line then is attached to the anchor plate 40. Several lead lines may be employed at the same time if the player intends to throw at several targets. The length of the lead line is selected based, at least in part, on the distance to the frame from the player. When used to train pitchers on a full-size field, the lead line is typically 55 feet long. When used on a Little League field, the lead line is typically 38 feet long. This permits a sufficient landing space after throwing from the mound. The lead line can be adjusted by using different sections 30*a*, 30*b***, or both.

Pitchers throw from a rectangular rubber. According to the pitcher's personal preference, the pitcher will push off the rubber from either the right side, the left side or the center of the rubber. There are three fasteners, such as eyes 13, loops 56 or holes, disposed beneath each target 22, 23, 24, 25 and 26. Vertically aligned targets, such as targets 22 and 23, share the same fasteners. The center fastener is aligned with the center of the target. The lead line is attached to the fastener under the target which will align the lead line with the center of the target and the pitcher's preference of rubber position. If the pitcher prefers to plant his foot on the right side of the rubber (typical for right-handed pitchers), the lead line is attached to the fastener on the right side of the target. If the pitcher prefers to pitch from the left side of the rubber (typical for left handers), the lead line is attached to the fastener on the left side of the target. If the pitcher prefers to pitch from the center of the rubber, the lead line is attached to the fastener directly below the center of the target.

Below the outer targets 21 and 27 (and 71 and 77, if present), there are only two fasteners. The outer fastener is aligned with the center of the target. When throwing at the far right target from the center or right of the rubber, the lead line is attached to the right fastener. When throwing at the far right target from the left of the rubber, the lead line is connected to the left fastener. The converse is true when throwing at the far left target.

Figure 7:
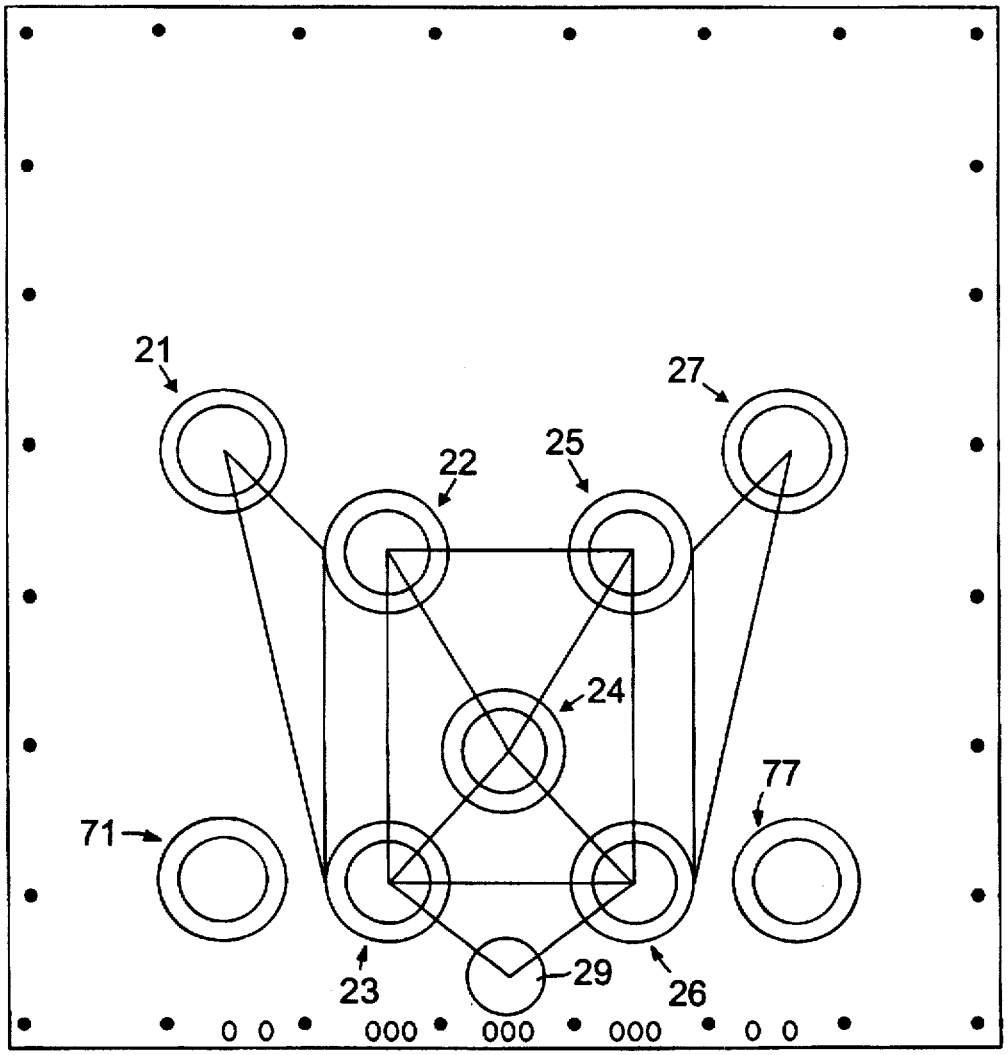
FIG. 7 is a front view of the tarpaulin showing target zones and additional targets.

FIG. 7 is a front view of the tarpaulin 20 showing the target zones and additional targets 71 and 77. The pitcher can throw at specific targets to improve his throwing accuracy. Alternatively, the pitcher can throw at a target zone composed of an area defined by selected targets. When the pitcher is in a game, he can visualize the target zones against the backdrop of the catcher.

As seen in FIG. 7, there are preferably seven target zones, each formed by three targets. Three target zones are outside the strike zone: 21,22,23;23,26,29; and 25,26,27. Four target zones are inside the strike zone: 22,23,24;22,24,25;24,25, 26; and 23,24,26. The additional targets can be employed to create two additional target zones, 71,22,23 and 25,26,77, for "off-the-plate" pitches for more experienced pitchers. The outlines of the targets need not be shown on the tarpaulin 20.

With the target zones, the pitcher can visualize both where he wants to throw and where he does not want to throw in a game situation. The pitcher can throw at the triangle formed by targets 23,24,26 in all game situations, for all pitches, particularly off-speed pitches. When throwing to a right-handed batter, the pitcher also would pitch at the triangle formed by the targets 24,25,26. When throwing to a left-handed batter, the pitcher would also pitch at the triangle formed by the targets 22,23,24. Pitchers can practice throwing "off-the-plate" by throwing to triangles 21,22,23 and 25,26,27. Pitchers can practice throwing low balls, particularly off-speed pitches, by throwing to triangle 23,26,29. Pitchers can practice throwing "brushback" or pitch outs by throwing at targets 21 and 27. Pitchers do not want to throw to triangle 22,24,25 in any game situation.

The pitcher can increase his accuracy and his confidence by throwing to a target or a target zone from a short distance, and then increasing that distance as the pitcher becomes more accurate. For example, the 17 foot long second section 30*b* can be attached to the fastener while the pitcher throws from about 25 feet from the tarpaulin 20. The second section can be replaced by the first section 30*a*, which is about 38 feet long, while the pitcher throws from about 45 feet from the tarpaulin. The first and second sections can be connected for a combined lead line of about 55 feet while the pitcher throws from the pitchers mound to the tarpaulin. Of course, sections of different length can be used, progressively increasing the length of the lead line and the distance between the pitcher and the tarpaulin.

The frame 10 can be moved to different positions on the field with a lead line 30 directed to the player to practice different types of throws. For example, the frame can be set up at second base facing home plate for training catchers to throw out base runners. The frame would be set up slightly to the first base side of second base. The lead line is attached to the center fastener under target 24. The catcher then can practice throwing from home plate to second base. The lead line may be lengthened, if desired, to help the catcher line up his throw.

The frame 10 can be set on any base or other position on the field to train any fielder. In particular, the frame can be placed on home plate or on second or third base, facing the outfield, to train outfielders to throw. The lead line 30 is attached to the center fastener beneath the target 24. The lead line may be lengthened to better direct the outfielder. Several sections 30*a* and 30*b* which are color-coded to match other targets, can be linked together to create a longer lead line. When this is done, preferably the white sections are positioned closest to the fielder to create a more immediate visual effect. Of course, lead lines can be attached to fasteners under several targets, creating an alley to thrown down.

The baseball training device 100 of the present invention can be used as a training aid to hitters as well. The hitter can practice location hitting with the device using "soft toss" pitching or a T-stand. The frame 10 is placed about 8–10 feet in front of the hitter with the tarpaulin 20 facing the hitter. The hitter tries to hit the ball at selected targets. The position where the ball hits the tarpaulin provides feedback to the hitter concerning his swing. Due to the sponge foam 51 in the tarpaulin, the ball does not rebound dangerously toward the hitter. The hitter can improve his hand path, swing plane and follow through with this exercise.

In another exercise, the frame 10 is placed behind home plate with the tarpaulin 20 facing the pitcher. The tarpaulin is spaced one bat length from the middle of the batter's torso, typically by placing one end of the bat on the batter's navel and positioning the tarpaulin against the other end of the bat. As the hitter swings the bat, the head of the bat should not move rearwardly a great distance. If the bat head does move too far rearwardly, it will contact the tarpaulin, which will provide a yielding resistance. The bat's contact with the tarpaulin will be felt as well as heard by the hitter, signalling him that the bat head has moved too far rearwardly. Similarly, the tarpaulin could be positioned on the opposite side of home plate from the hitter. If the hitter swings too far out from his body, the bat will contact the tarpaulin, which will provide a yielding resistance and make a sound, thereby signalling the hitter.

With the frame 100 in the same position, the hitter can take batting practice with the tarpaulin 20 operating as a backstop. The hitter can watch the ball's trajectory from the pitcher, judging whether it was in or out of the strike zone. The hitter then can watch to see where the ball hits the tarpaulin to evaluate his judgement. Preferably, the hitter swings at some pitches and merely watches others. In particular, the hitter can watch two and swing at two, repeating this sequence. The hitter will get a better understanding of the path of the ball into the strike zone through this exercise.

The frame 10 can be placed between the hitter and the pitchers mound with the tarpaulin 20 facing the hitter. As the hitter swings the bat, a coach calls out a number corresponding to one of the targets. The hitter adjusts his swing, mid-swing, to swing the bat head in the direction of the recited target. The closeness of the bat head to the direction of the target indicates the hitter's ability to make last second adjustments. This will aid the hitter in making adjustments to hit the ball.

While the current embodiment is intended for use with baseballs, the frame, tarpaulin and targets can be appropriately sized for use with softballs, footballs, basketballs, golf balls, tennis balls or any sport where trajectory accuracy of projectiles or the control of a swing is important. The foregoing description is not to be construed as a limitation on the scope of the invention which is defined by the following claims:

I claim:

1. A sports training device comprising:

a frame having vertical supports;

a tarpaulin secured to the frame;

one or more targets arranged on the tarpaulin;

one or more fasteners secured in a predetermined spacial relationship with a selected target; and a lead line having a first end adapted to be engaged with a selected fastener, the lead line extending from the selected fastener below the selected target toward a player-in-training and being adapted to provide a visible guide line from a point near the player to a point below the selected target for alignment with the selected target.

2. The sports training device of claim 1 further comprising an anchor having one or more attachment points wherein a second end of the lead line is adapted to engage a selected attachment point.

3. The sports training device of claim 1 comprising:

a first target located approximately at the upper left hand corner of a box;

a second target located approximately at the lower left hand corner of the box;

a third target located approximately at the lower right hand corner of the box; and a fourth target located approximately at the upper right hand corner of the box.

4. The sports training device of claim 3 further comprising a fifth target disposed on a vertical center line of the box and slightly below a horizontal center line of the box.

5. The sports training device of claim 4 further comprising:

a sixth target located a predetermined distance above and to the left of the first target; and a seventh target located above and to the right of the fourth target.

6. The sports training device of claim 5 wherein one or more of the targets comprise a hole having a predetermined diameter disposed in the tarpaulin.

7. The sports training device of claim 6 further comprising:

a eighth target located a predetermined distance to the left of the second target; and a ninth target located a predetermined distance to the right of the third target.

8. The sports training device of claim 1 further comprising:

a catch bag attached to the tarpaulin on a rear side surrounding the target or targets and being adapted to encourage a ball passing through a target into the catch bag to exit the catch bag through an exit hole.

9. The sports training device of claim 1 wherein the lead line is the same color as the selected target.

10. The sports training device of claim 1 wherein at least two fasteners are in different predetermined relationships with each target.

11. The sports training device of claim 1 wherein each fastener is vertically aligned with a target.

12. The apparatus of claim 1 further comprising a flexible cord wrapped around the frame and hooked to the tarpaulin.

13. The apparatus of claim 1 wherein the one or more fasteners comprises three loops attached to the tarpaulin beneath the selected target, wherein the lead line is attached to one of the loops.

14. The apparatus of claim 1 further comprising a matting selectively engaged to the frame.

15. The sports training device of claim 9 wherein the selected target further comprises a colored border surrounding a hole, the border color matching the lead line.

16. The sports training device of claim 9 wherein the selected target further comprises a piece of material behind a hole and in the line-of-sight through the front of the hole.

17. A sports training device comprising:

a frame having vertical supports;

a tarpaulin secured to the frame;

a first target located approximately at the upper left hand corner of a box;

a second target located approximately at the lower left hand corner of the box;

a third target located approximately at the lower right hand corner of the box;

a fourth target located approximately at the upper right hand corner of the box; and a fifth target located approximately on a vertical center line of the box and slightly below a horizontal center line of the box such that the fifth target is separated by a distance from a bottom and from a left and a right side of the box;

a sixth target located a predetermined distance above and to the left of the box; and a seventh target located a predetermined distance above and to the right of the box the first through seventh targets each comprising a circle having a predetermined diameter disposed on the tarpaulin and a border surrounding a hole.

18. The sports training device of claim 17 further comprising:

an eighth target having a predetermined diameter located below and substantially on a vertical centerline of the box.

19. The sports training device of claim 17 further comprising:

a fastener secured to a lower horizontal portion of the sports training device in a predetermined alignment with one or more selected targets and adapted to engage one end of a lead line.

20. The sports training device of claim 19 wherein said predetermined alignment comprises a vertical centerline of said one or more selected targets.

21. The sports training device of claim 19 wherein said predetermined alignment comprises a predetermined offset from a vertical centerline of said one or more selected targets.

22. The sports training device of claim 19 further comprising a second fastener spaced an offset from a vertical centerline of the one or more selected targets; and wherein said predetermined alignment comprises alignment with a vertical centerline of said one or more selected targets.

23. The apparatus of claim 19 wherein the fastener comprises three loops attached to the tarpaulin beneath the one or more selected targets, and further comprising a lead line having a first end for engagement with a selected one of the loops and a second end for placement near a player, the lead line being adapted to provide a visible guide line for alignment with the one or more selected targets.

24. The sports training device of claim 19 further comprising:

a lead line having a first end for engagement with the fastener and a second end for placement near a player, the lead line being adapted to provide a visible guide line for alignment with said one or more selected targets.

25. The sports training device of claim 24 wherein at least one of the one or more selected targets comprises a first color; and the lead line further comprises a color matching the first color.

26. The sports training device of claim 25 wherein the at least one target further comprises a colored border surrounding the hole, the border color matching the lead line.

27. The sports training device of claim 25 wherein the target further comprises a piece of material behind the hole, and in line of sight through the front of the hole.

28. The sports training device of claim 24 further comprising an anchor having one or more attachment points adapted to mate with the second end of one or more of said visual lead lines.

29. The sports training device of claim 24 wherein the fastener is attached to the tarpaulin.

30. The sports training device of claim 24 wherein the fastener is attached to the frame.

31. The sports training device of claim 17 wherein the predetermined diameter is approximately 6 inches and the border is approximately 1.25 inches wide.

32. The sports training device of claim 17 wherein the predetermined diameter is approximately 2.2 times the diameter of a ball to be used with the sports training device.

33. The sports training device of claim 17 wherein the box approximately comprises the dimensions of a strike zone.

34. The sports training device of claim 17 wherein the box dimensions are approximately 24.5 inches high and at least 19 inches wide.

35. The sports training device of claim 17 wherein the tarpaulin is secured to the frame by flexible cord wrapped around the frame and hooked to the tarpaulin such that the impact of a ball is absorbed.

36. The sports training device of claim 17 wherein the tarpaulin is secured to the frame by flexible elastic cord wrapped around the frame and hooked to the tarpaulin such that the impact of a ball is absorbed.

37. The sports training device of claim 17 wherein the tarpaulin further comprises a sandwich structure of durable flexible material on the outside and a compressible shock absorbing material on the interior.

38. The sports training device of claim 37 wherein the durable flexible material comprises at least one layer of 18 ounce grade polyvinyl and the compressible shock absorbing material comprises an approximately ¼ inch thick sponge material.

39. A sports training device comprising:

a frame having vertical supports;

a tarpaulin secured to the frame;

a first target located approximately at the upper left hand corner of a box;

a second target located approximately at the lower left hand corner of the box;

a third target located approximately at the lower right hand corner of the box;

a fourth target located approximately at the upper right hand corner of the box; and a fifth target located approximately on a vertical center line of the box and slightly below a horizontal center line of the box such that the fifth target is separated by a distance from a bottom and from a left and a right side of the box;

a sixth target located a predetermined distance above and to the left of the box; and a seventh target located a predetermined distance above and to the right of the box the first through seventh targets each comprising a circle having a predetermined diameter disposed on the tarpaulin;

an eighth target having a predetermined diameter located below and substantially on a vertical centerline of the box;

a catch bag attached to the rear side of the tarpaulin; and wherein each of the circles comprises a hole having the predetermined diameter disposed in the tarpaulin;

the catch bag surrounding the targets and being adapted to encourage balls passing through a target to exit the catch bag through the tarpaulin.

40. The sports training device of claim 39 further comprising:

a ninth target having a predetermined diameter located below the sixth target and a predetermined distance to the left of the box; and a tenth target having a predetermined diameter located below the seventh target and a predetermined distance to the right of the box.

41. A sports training device comprising:

a tarpaulin for use with a supporting structure;

at least eight targets disposed on the tarpaulin;

the first target being located approximately at the upper left hand corner of a box;

the second target being located approximately at the lower left hand corner of the box;

the third target being located approximately at the lower right hand corner of the box;

the fourth target being located approximately at the upper right hand corner of the box;

the fifth target being located approximately on a vertical center line of the box and slightly below a horizontal center line of the box;

the sixth target being located a predetermined distance above and to the left of the box;

the seventh target being located a predetermined distance above and to the right of the box;

the eighth target being located below and substantially on a vertical centerline of the box;

the targets each comprising a hole having a predetermined diameter disposed in the tarpaulin; and the first through seventh targets further comprising a border around the hole.

42. The sports training device of claim 41 further comprising:

a catch bag attached to the rear side of the tarpaulin, surrounding the targets, and being adapted to encourage balls passing through a target to exit the catch bag through the tarpaulin.

43. The sports training device of claim 42 further comprising:

a supporting structure; and a fastener secured to a lower horizontal portion of the sports training device in a predetermined alignment with one or more selected targets;

the fastener being adapted to engage one end of a lead line extending from the one or more selected targets toward a player-in-training, the lead line being adapted to provide a visible guide line for alignment with said one or more selected targets.

44. The sports training device of claim 41 wherein the holes of the first through fourth targets are substantially aligned with a respective corner of the box and the predetermined diameter is approximately six inches.

45. A sports training device comprising:

a tarpaulin for use with a supporting structure;

a first target located approximately at the upper left hand corner of a box;

a second target located approximately at the lower left hand corner of the box;

a third target located approximately at the lower right hand corner of the box;

a fourth target located approximately at the upper right hand corner of the box; and a fifth target located approximately on a vertical center line of the box and slightly below a horizontal center line of the box such that the fifth target is separated by a distance from a bottom and from a left and a right side of the box;

the first through fifth targets each comprising a hole having a predetermined diameter disposed in the tarpaulin and each target further comprises a color and a border around the hole comprises the color.

46. The sports training device of claim 45 wherein a center of the hole of the first through fourth targets are substantially aligned with a respective corner of the box.

47. The sports training device of claim 46 wherein the box approximately comprises the dimensions of a strike zone.

48. The sports training device of claim 46 wherein the box dimensions are approximately 24.5 inches high and at least 19 inches wide.

49. The sports training device of claim 46 wherein the box is positioned on the tarpaulin such that the bottom edge of the box corresponds to the bottom of a strike zone.

50. The sports training device of claim 46 wherein the tarpaulin dimensions are approximately 86 inches wide by 73 inches high.

51. The sports training device of claim 46 further comprising:

a sixth target located a predetermined distance above and to the left of the box;

a seventh target located a predetermined distance above and to the right of the box;

an eighth target located below and substantially on a vertical centerline of the box.

52. The sports training device of claim 45 further comprising a piece of material behind the hole in a line-of-sight from the front of the hole.

53. A method of using a sports training device to train a player to throw a ball, the sports training device having a tarpaulin for use with a supporting structure;

at least eight targets disposed on the tarpaulin;

the first target being located approximately at the upper left hand corner of a box;

the second target being located approximately at the lower left hand corner of the box;

the third target being located approximately at the lower right hand corner of the box;

the fourth target being located approximately at the upper right hand corner of the box;

the fifth target being located approximately on a vertical center line of the box and slightly below a horizontal center line of the box;

the sixth target being located a predetermined distance above and to the left of the box;

the seventh target being located a predetermined distance above and to the right of the box;

the eight target being located below and substantially on a vertical centerline of the box;

the targets each comprising a hole having a predetermined diameter disposed in the tarpaulin;

the first through seventh targets each further comprising a border around the hole; and the method comprising:

positioning the tarpaulin a predetermined distance from the player;

defining a target zone as a triangle formed by three targets; and having the player throw balls at the target zone.

54. The method of claim 53 wherein:

the box corresponds approximately to a strike zone, and the target zone comprises the triangle formed by the second, third, and fifth targets.

55. The method of claim 53 wherein:

the box corresponds approximately to a strike zone, and the target zone comprises the triangle formed by the first, second, and fifth targets.

56. The method of claim 53 wherein:

the box corresponds approximately to a strike zone, and the target zone comprises the triangle formed by the third, fourth and fifth targets.

57. The method of claim 53 wherein:

the box corresponds approximately to a strike zone, and the target zone comprises the triangle formed by the the first, second, and sixth targets.

58. The method of claim 53 wherein:

the box corresponds approximately to a strike zone, and the target zone comprises the triangle formed by the third, fourth, and seventh targets.

59. The method of claim 53 wherein:

the box corresponds approximately to a strike zone, and the target zone comprises the triangle formed by the second, third, and eighth targets.

60. The method of claim 53 further comprising:

throwing at a selected one of the three targets within the target zone.

61. A method of using a sports training device to train a player to throw a ball, the sports training device having a tarpaulin for use with a supporting structure;

at least five targets disposed on the tarpaulin;

the first target being located approximately at the upper left hand corner of a box;

the second target being located approximately at the lower left hand corner of the box;

the third target being located approximately at the lower right hand corner of the box;

the fourth target being located approximately at the upper right hand corner of the box;

the fifth target being located approximately on a vertical center line of the box and slightly below a horizontal center line of the box such that the fifth target is separated by a distance from a bottom and from a left and a right side of the box;

the targets each comprising a hole having a predetermined diameter disposed in the tarpaulin; and each target further comprises a color and a border around the hole comprises the color the method comprising:

positioning the tarpaulin a predetermined distance from the player;

defining a target zone as a triangle formed by three targets; and having the player throw balls at the target zone.

62. The method of claim 61 wherein:

the box corresponds approximately to a strike zone, and the target zone comprises the triangle formed by the second, third, and fifth targets.

* * * * *